US012196416B2

(12) United States Patent
Dombrowski et al.

(10) Patent No.: US 12,196,416 B2
(45) Date of Patent: Jan. 14, 2025

(54) BURNER FOR REDUCING NOX EMISSIONS AND METHOD FOR OPERATING THE BURNER

(71) Applicant: Econova GmbH, Bochum (DE)

(72) Inventors: Bert Dombrowski, Hattingen (DE); Horst Graf Von Schweinitz, Bochum (DE)

(73) Assignee: Econova GmbH, Bochum (DE)

( * ) Notice: Subject to any disclaimer, the term of this patent is extended or adjusted under 35 U.S.C. 154(b) by 473 days.

(21) Appl. No.: 17/297,896

(22) PCT Filed: Jun. 21, 2019

(86) PCT No.: PCT/EP2019/066530
§ 371 (c)(1),
(2) Date: May 27, 2021

(87) PCT Pub. No.: WO2020/253970
PCT Pub. Date: Dec. 24, 2020

(65) Prior Publication Data
US 2022/0034504 A1 Feb. 3, 2022

(51) Int. Cl.
*F23D 14/22* (2006.01)
*F23C 3/00* (2006.01)
(Continued)

(52) U.S. Cl.
CPC ..... *F23D 14/22* (2013.01); *F23C 3/002* (2013.01); *F23C 7/06* (2013.01); *F23L 15/04* (2013.01);
(Continued)

(58) Field of Classification Search
CPC .. F23C 2900/06041; F23C 2900/07022; F23C 2900/99001; F23C 2900/99006;
(Continued)

(56) References Cited

U.S. PATENT DOCUMENTS 4,373,903 A * 2/1983 Wunning ..... F23L 15/04 239/129
5,344,310 A * 9/1994 Harbeck ..... F23D 14/22 431/158
(Continued)

FOREIGN PATENT DOCUMENTS

DE 29708561 U1 * 7/1997 ..... F23D 14/02
EP 0164576 A2 12/1985
(Continued)

OTHER PUBLICATIONS

International Search Report of International Searching Authority for PCT/EP2019/066530, ISA/EP, Rijswijk, Netherlands, Dated: Feb. 24, 2020.
(Continued)

*Primary Examiner* — Michael G Hoang
*Assistant Examiner* — Logan P Jones
(74) *Attorney, Agent, or Firm* — M&B IP Analysts, LLC

(57) ABSTRACT

A burner for heating a heating space with a reduction of NOx emissions is provided. The burner includes a mixing and combustion chamber, a mixing and igniting device disposed in the mixing and combustion chamber, and a fuel feed connected to the mixing and igniting device and configured for feeding fuel to the mixing and igniting device. Further, an air feed is provided, which is configured for feeding at least one partial air flow to the mixing and combustion chamber. A combustion chamber opening opens the mixing and combustion chamber towards a heating space to be heated. Furthermore, control means are configured for controlling a fuel flow via the fuel feed and for controlling at least one partial air flow via the air feed.

14 Claims, 4 Drawing Sheets

(51) Int. Cl.
*F23C 7/06* (2006.01)
*F23C 9/00* (2006.01)
*F23L 15/04* (2006.01)

(52) U.S. Cl.
CPC *F23C 2900/99006* (2013.01); *F23D 2207/00* (2013.01); *F23D 2208/005* (2013.01)

(58) Field of Classification Search
CPC .. F23C 3/002; F23C 7/06; F23C 9/006; F23D 14/22; F23D 2207/00; F23D 2208/005; F23L 15/04
See application file for complete search history.

(56) References Cited

U.S. PATENT DOCUMENTS 5,570,679 A * 11/1996 Wunning ..... F23C 7/06 126/91 A
6,872,070 B2 * 3/2005 Moore ..... F23C 3/002 126/91 A
9,995,481 B2 6/2018 Hong et al.
10,161,632 B2 * 12/2018 Wünning ..... F23D 14/126
2006/0246388 A1 * 11/2006 Feese ..... F23D 14/84 431/215
2013/0157204 A1 * 6/2013 Hong ..... F23D 14/66 431/354

FOREIGN PATENT DOCUMENTS

EP 0685683 A2 12/1995
EP 2498002 A1 9/2012
EP 2778521 B1 7/2018
JP S6149910 A 3/1986
JP H09152108 A * 6/1997

OTHER PUBLICATIONS

Written Opinion of International Searching Authority for PCT/EP2019/066530, ISA/EP, Rijswijk, Netherlands, Dated: Feb. 24, 2020.
Japanese office action for application No. 2021-531376, dated Aug. 23, 2022. Japan Patent Office.

* cited by examiner

BURNER FOR REDUCING NOX EMISSIONS AND METHOD FOR OPERATING THE BURNER

CROSS-REFERENCE TO RELATED APPLICATIONS

This application claims priority under 35 U.S.C. § 371 to the International Application No. PCT/EP2019/066530, filed Jun. 21, 2019, now pending, the contents of which are hereby incorporated by reference.

DESCRIPTION

The invention relates to a burner for heating a heating space with a reduction of NOx emissions, comprising a mixing and combustion chamber and a combustion chamber opening which opens the mixing and combustion chamber towards a heating space to be heated. A flame, with whose heat the heating space is heated, is generated in the mixing and combustion chamber. The invention further relates to a method for operating such a burner.

Burners of this type are used particularly for heating furnace spaces in industrial thermoprocessing systems, which may be chamber furnaces for heat treatment, bogie hearth furnaces for heating and forging, roller hearth furnaces or rotary hearth furnaces, for example. However, these examples are to be understood merely as examples, because the application of such industrial burners is varied.

The burners are operated with a gaseous of liquid fuel together with air or oxygen. Here, impulse burners or high-performance burners, in which fuel and air are mixed and ignited in a combustion chamber, are increasingly used. The hot combustion gases produced flow at high speed through a combustion chamber opening into the heating space to be heated. The heating space may be a furnace space itself, or a radiant tube which, gas-tight, protrudes through a furnace wall into a furnace space.

Here, the goal is to produce as low $NO_x$ values as possible during combustion, which, however, depends on various parameters that affect one another. For example, operating an industrial burner in two modes of operation has proved to be an advantageous measure, wherein the second mode of operation includes a flameless oxidation that permits low $NO_x$ values.

For example, EP 0 685 683 B1 discloses an industrial burner, which can be switched between a start-up operation with a flame within a mixing and combustion chamber and a heating operation with a flameless oxidation outside the mixing and combustion chamber. Two different fuel nozzle devices are provided for this purpose, with which fuel can be optionally brought into the mixing and combustion chamber (start-up operation) and into the vicinity of a combustion chamber outlet opening (heating operation). The switch between the start-up operation and the heating operation takes place after reaching a predetermined temperature in the heating space, wherein this temperature is above the ignition temperature of the fuel/air mixture, so that the mixture is able to combust without any additional ignition in the region of the combustion chamber outlet opening for a flameless oxidation.

However, this type of industrial furnace requires two different fuel feeds and a switching process during high-temperature operation. Moreover, due to the flameless oxidation, it is incapable of realizing its low $NO_x$ values in regions of a heating space that do not reach, or have not yet reached, the above-mentioned ignition temperature. Moreover, the industrial furnace requires elaborate monitoring, because the flame is extinguished in the mixing and combustion chamber after the switch to the heating operation and the furnace thus cannot be monitored any longer based on the presence of this flame.

It is therefore an object of the invention to provide a burner and a method for operating the burner with which low $NO_x$ values can be attained while avoiding, in particular, the above-mentioned drawbacks.

It must be noted that the features cited individually in the claims can be combined with each other in any technologically meaningful manner and represent other embodiments of the invention. The description, in particular in connection with the figures, additionally characterizes and specifies the invention.

A heating space can be heated with the burner according to the invention, wherein the heating space is, for example, a furnace space or a radiant tube protruding into the furnace space to be heated. Therefore, the burner may be operated with a direct firing mode or with a radiant tube. Various types of radiant tubes may be used as a radiant tube. For example, it is a SER-type radiant tube (Single Ended Radiant Tube). However, P-type or DP-type radiant tubes may also be used, for example. A furnace space is preferably equipped with several burners. This is an industrial burner used, in particular, for directly heating furnace spaces in industrial thermoprocessing systems. The $NO_x$ emissions can be reduced with the structure and the manner of operation of the burner according to the invention, wherein the burner, however, also involves further advantages.

For this purpose, the burner according to the invention includes a mixing and combustion chamber within which a mixing and igniting device is disposed. A fuel feed is connected to the mixing and igniting device and configured for feeding fuel to the mixing and igniting device. Further, an air feed is provided, which is configured for feeding a first partial air flow to the mixing and combustion chamber. The burner is operated with air and a fuel, which is liquid or preferably gaseous. For instance, natural gas is used. The mixing and combustion chamber opens via a combustion chamber opening towards the heating space to be heated.

Moreover, the burner provides control means configured for controlling a fuel flow B via the fuel feed and for controlling at least one partial air flow via the air feed. The burner and these control means are configured for operating the burner with a stable flame extending from the mixing and igniting device through the combustion chamber opening into the heating space. Such an elongated flame has flame zones with different characteristics. At least, this is a first flame zone within the mixing and combustion chamber which can be detected, for example, by means of an ionization electrode. A second flame zone, which is characterized by the high speed of the exiting flows, is formed outside the combustion chamber opening.

According to the invention, the cross-section of the combustion chamber opening relative to the burner output is in the range of between 1.5 $mm^2/kW$ and 10 $mm^2/kW$. In one embodiment of the invention, the cross-section of the combustion chamber opening relative to the burner output is in the range of between 1.5 $mm^2/kW$ and 8 $mm^2/kW$, preferably between 1.5 $mm^2/kW$ and 6 $mm^2/kW$, particularly preferably between 1.5 $mm^2/kW$ and 5 $mm^2/kW$.

With these values, very high exit speeds can be attained in the region of the combustion chamber opening, by which waste gases are in turn suctioned to an increased degree from the heating space into the flame in this region. In the process the cross-section of the combustion chamber opening is selected to be considerably smaller than is the case in known burners. In known air/fuel burners, for example, cross-sections of the combustion chamber opening in relation to the burner output of above 10 $mm^2/kW$ are often provided. A substantial reduction of this value is avoided because experience has shown that the flame can then no longer be operated in a stable and reliable manner. However, the invention is based on the insight that values considerably below 10 $mm^2/kW$ can also be realized, given a suitable configuration and operation of the burner. In particular, this takes place together with the generation of a stable flame in the region of the igniting and mixing device. Therefore, the control means and the mixing and igniting device are configured for generating a stable flame in the mixing and combustion chamber.

The invention yields higher exit speeds at the combustion chamber opening, which in turn cause an intensification of the suctioning of the waste gases from the heating space, whereby the NOx emissions can be reduced. $NO_x$ values in the range of 5 to 100 $mg/Nm^3$ or, with an SER radiant tube, of 50 to 150 $mg/Nm^3$ relative to 3% $O_2$ in the dry waste gas can be attained. Furthermore, particularly in the case of a long SER radiant tube, due to the increased exit speeds, it is possible to improve the temperature profile in the heating space.

The invention is further advantageous in that the stable flame in the region of the mixing and igniting device is continuously detectable and thus capable of being monitored. Therefore, in one embodiment of the invention, flame monitoring means, which are configured for detecting a flame in the region of the mixing and igniting device, are provided in the mixing and combustion chamber. The flame monitoring means include, for instance, an ionization bar that protrudes into a zone of the flame. The flame monitoring means are used for monitoring the presence of the flame in the mixing and combustion chamber, which can be done comparatively easily and reliably as compared with solutions involving high-temperature switching.

Thus, the function of the burner can be monitored in a simple manner based on the presence of the flame in the combustion chamber. Therefore, the invention offers the option, for the purpose of attaining low NOx values in the range of 5 to 100 $mg/Nm^3$ or 50 to 150 $mg/Nm^3$ relative to 3% $O_2$ in dry waste gas, not to have to use flameless oxidation, whose monitoring is complex and comparatively unreliable because there is no flame that can be monitored.

Moreover, an NOx reduction is possible with the burner according to the invention already starting from a heating space temperature of about 300 to 500° C., whereas this is possible only starting from temperatures of about 800° C. if flameless oxidation is used. Thus, the burner according to the invention can advantageously be used in areas of a thermoprocessing system in which high output is required, but in which the temperature in an area to be heated is not, or not yet, above 800° C. The burner according to the invention is fully effective in, for example, the high-output first zones of a continuous furnace.

Preferably, a recuperator is also provided, which at least partially surrounds the air feed of the burner. However, the invention may also be used in burner configurations without a recuperator. Such recuperators can be configured in a variety of manners and substantially include means for receiving hot waste gases from the heating space in the recuperator. Moreover, they include means for feeding air for combustion to the recuperator and for heating up this combustion air by means of the hot waste gases guided through the recuperator. The recuperator is configured accordingly in order to realize a suitable heat transfer between the hot waste gases and the supplied combustion air. Via the recuperator, a second air flow L2 can thus be fed to the mixing and combustion chamber or the heating space outside the mixing and combustion chamber. Whether this second air flow L2 is fed from the recuperator to the mixing and combustion chamber, or directly to the heating space to be heated, depends on the design of the burner. The first partial air flow L1 may optionally also be preheated by the recuperator.

The attainable cross-sections of the combustion chamber opening also depend substantially on the design of the burner with the recuperator, because the combustion air preheated by the recuperator can be transferred to the combustion process in various manners. In one embodiment of the invention, the air feed is formed by an air feed pipe, for instance, within which the mixing and igniting device is disposed in such a way that the mixing and combustion chamber is formed. In this case, the air feed pipe forms the combustion chamber opening. In the case of such a design, very small diameters for the combustion chamber opening can be realized, wherein the cross-section of the combustion chamber opening relative to the burner output is in the range of between 1.5 $mm^2/kW$ and 5 $mm^2/kW$, particularly preferably between 2.5 $mm^2/kW$ and 3.5 $mm^2/kW$, for instance.

In a design with the recuperator, the second partial air flow L2 is guided from the recuperator into the heating space, for example. In that case, a second preheated air flow L2 is not directly fed into the mixing and combustion chamber, but rather, this second partial air flow L2 is fed to the flame zone outside the mixing and combustion chamber.

In another design of the burner with a recuperator, the air feed is also formed by an air feed pipe, within which the mixing and igniting device is disposed in such a way that the mixing and combustion chamber is formed. In this embodiment, however, the recuperator forms the combustion chamber opening, while the second preheated partial air flow L2 is guided from the recuperator preferably also into the mixing and combustion chamber. The total air flow into the mixing and combustion chamber is thus greater than in the previously described embodiment, however, very small diameters for the combustion chamber opening can be realized, wherein the cross-section of the combustion chamber opening relative to the burner output is in the range of between 3 $mm^2/kW$ and 10 $mm^2/kW$, particularly preferably between 3 $mm^2/kW$ and 6 $mm^2/kW$.

In one embodiment of the invention, the control means are further configured for varying, in particular increasing, the ratio of the fuel flow B to the air flow subsequent to reaching a predetermined parameter value. In designs with a recuperator and several partial air flows, the ratio of the fuel flow B to the sum of the first and the second preheated air flow is varied, in particular increased. In one embodiment of the invention, the control means are preferably configured to increase the fuel flow B, subsequent to reaching a predetermined parameter value, while the air flow (in particular the sum of the first and the second preheated air flow) remains approximately the same. The predetermined parameter value is a temperature value, which is, in particular a reference temperature in a space to be heated or in a certain zone within the space to be heated (zone temperature). However, the space need not be the heating space of the invention, rather, a suitable reference point for temperature is determined which may vary depending on the mounting situation of the burner. Preferably, the reference temperature is chosen or experimentally determined such that, starting from this temperature, the ratio of the fuel flow B to the air flow can be changed from 1:20 to 1:10 if natural gas is used as a fuel, for example. For example, this temperature is between 200° C. and 500° C. Other gaseous fuels may lead to other suitable mixing ratios, so that the above-specified change of the mixing ratio for natural gas serves merely as an example for illustrating the invention.

This type of control means makes it possible, in particular, to start up the burner in a cold state with a ratio of fuel flow B to air flow (in particular to the sum of the first and the second, preheated air flow) of 1:20. This makes it possible to form a stable flame extending through the combustion chamber opening into the heating space. If the burner and the furnace heat up as the burner continues to operate, the ratio may also be adjusted to 1:10, however, without the flame being destabilized thereby. The burner is preferably operated with a full amount of air at, at first, half output, and its operation can then be continued at full output if certain temperature conditions are reached that also enable a sufficient stabilization of the flame. Thus, a stable flame can be generated in the various stages of heating of the burner, despite the high exit speed in the region of the combustion chamber opening.

Optionally, the burner includes means for switching the burner into an operation with a flameless oxidation. For example, means for redirecting the flow of the fuel flow and/or the first partial air flow are provided for this purpose, upon whose activation by the control means the flame is destabilized and extinguished. Further, the burner is configured in such a way that, then, a flameless oxidation of fuel and air, which exit the combustion chamber opening at high speed, takes place outside the combustion chamber opening. The precondition for this is that the temperature in this area has reached a value above the ignition temperature of the mixture, i.e. approximately 800° C. Corresponding temperature monitoring means connected to the control means are provided for this purpose. Also, in the case of this flameless oxidation, the increased exit speeds of fuel and air at the combustion chamber opening cause an advantageous increased suctioning of the waste gases, which in turn reduces the NOx values.

Such a redirection of the flow for switching to the flameless oxidation may be realized, for instance, by an extended fuel lance protruding into the area of the combustion chamber opening, as is proposed in EP 0 685 683 B1. The control of a changed exit of fuel from the igniting and mixing device is also possible.

The invention also includes a method for operating a burner according to an embodiment of the invention, in which the control means control a fuel flow and at least one partial air flow in such a way that a stable flame is formed, which extends from the mixing and igniting device through the combustion chamber opening into the heating space.

The method includes the optional measure, particularly for a heating-up phase, that the control means increase the ratio of the fuel flow to the air flow subsequent to reaching a predetermined parameter value. In particular, this is affected by the control means increasing the fuel flow while the air flow remains approximately the same, as was already described. For example, the control means change the ratio of the fuel flow to the air flow from 1:20 to 1:10. In designs including a recuperator, the above-mentioned air flow is composed of a first and a second partial air flow. Consequently, the method also provides that the predetermined parameter value is a temperature in a space to be heated, and that this temperature is between 200° C. and 500° C. This process mode has the above-mentioned advantages.

For an optional switch to an operation with a flameless oxidation, the method provides in one embodiment that the temperature $T_H$ of the heating space is determined and, upon reaching a predetermined temperature $T_H$ above the ignition temperature of the fuel/air mixture, the flow of the fuel flow and/or the first partial air flow are redirected in such a way that the flame is destabilized and extinguished, and then, a flameless oxidation of fuel and air, which exit the combustion chamber opening, takes place outside the combustion chamber opening. This process mode has the above-mentioned advantages.

Other advantages, special features and expedient further developments of the invention are apparent from the dependent claims and the following presentation of preferred embodiments with reference to the illustrations.

Figure 1:
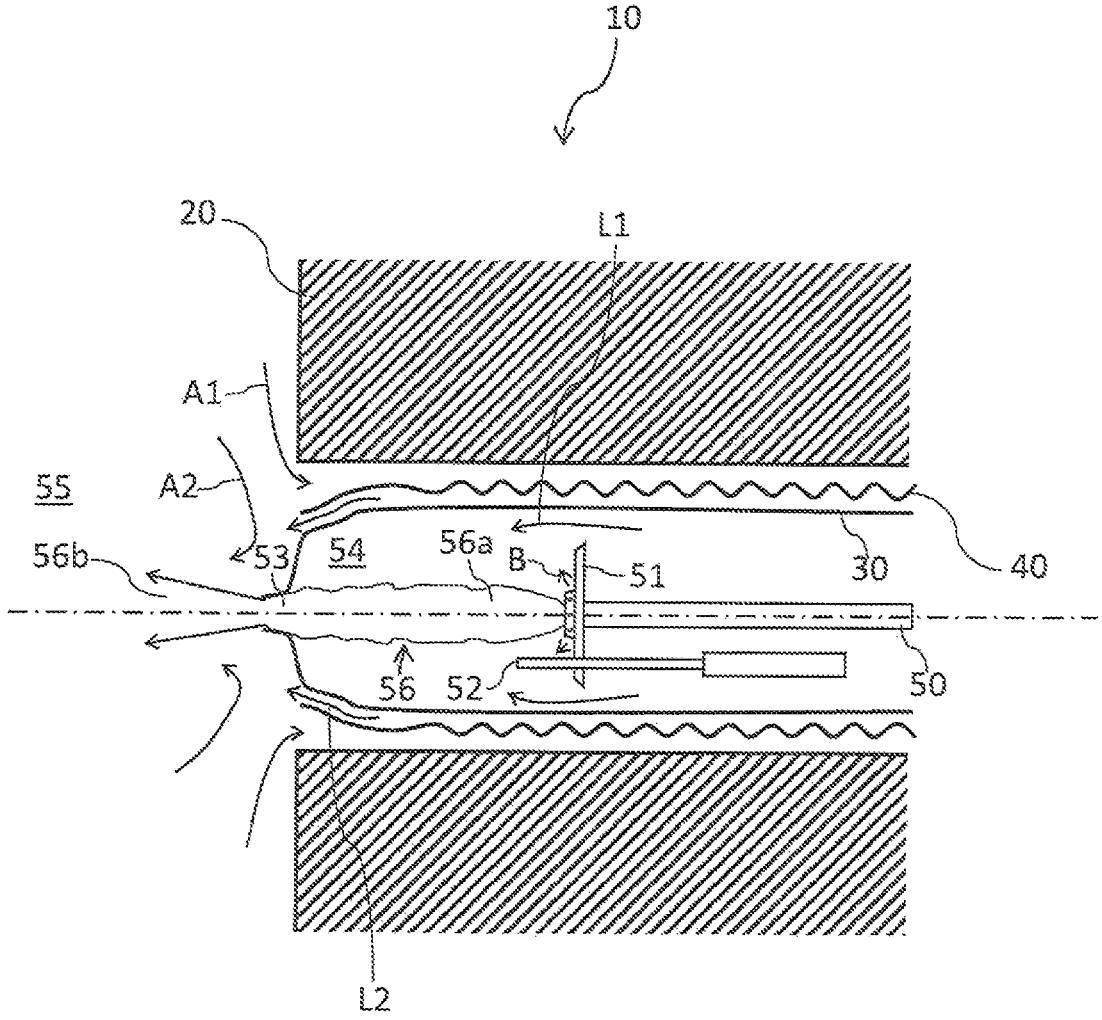
FIG. 1 shows a schematic cross-section through a first embodiment of a burner according to an embodiment.

FIG. 1 schematically shows a first embodiment of a burner 10 according to the invention, based on which the essential features of the invention are to be explained. However, the structure of the burner is not to be understood to be limiting, and FIG. 1 presents, in particular, only a schematic representation of the components and component dimensions. The same also applies to the FIGS. 3 and 4 that show further embodiments. Designs without a recuperator are also included.

Figure 4:
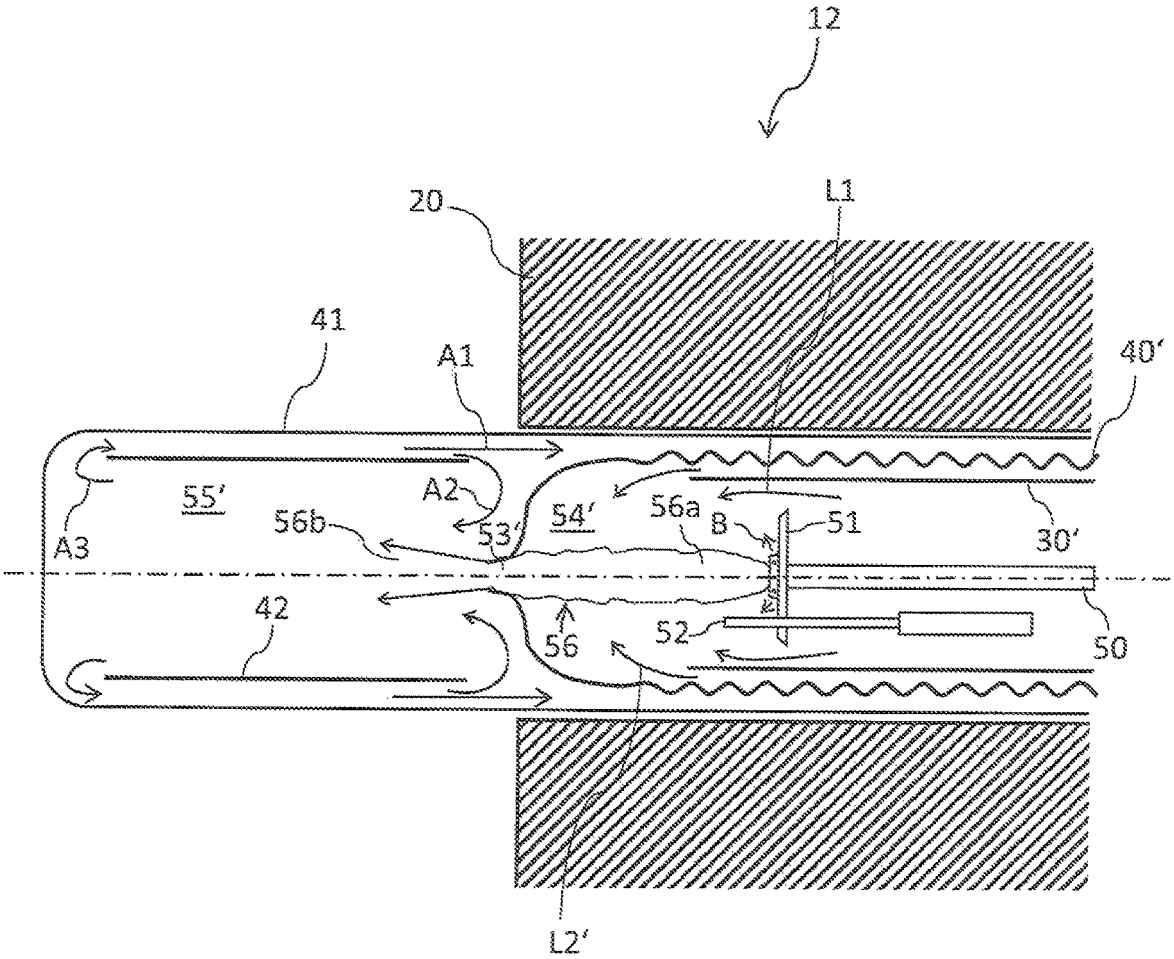
FIG. 4 shows a schematic cross-section through a third embodiment of a burner according to an embodiment.

The burner 10 is built into a furnace wall 20 and generates a flame 56 with which a heating space 55 is to be heated. In this embodiment, this is an open flame directly heating the heating space 55. However, other embodiments with indirect heating are possible, in which a radiant tube is used. FIG. 4 shows such an embodiment.

The burner 10 has a mixing and combustion chamber 54 which is formed by an air feed 30 in the form of an air feed pipe. Combustion air is introduced (not shown) into this air feed 30 and flows into the mixing and combustion chamber 54 as a first partial air flow L1. An igniting and mixing device 51 connected to a fuel feed 50 through which fuel is fed to the igniting and mixing device 51 is secured within this air feed pipe 30. The fuel is natural gas, for instance.

The igniting and mixing device 51 is configured in a suitable manner such that the fuel exits it in such a way that a stable flame 56 can be produced by igniting the mixture of the fuel flow B and the first partial air flow L1. In the schematic representation of FIG. 1, several fuel flows exit the igniting and mixing device 51 laterally at an angle for this purpose, but this is not to be understood as limiting. Any other suitable igniting and mixing device 51 may also be used.

In this embodiment, the burner further includes a recuperator 40 surrounding the air feed pipe 30. Hot waste gases A1 are drawn from the heating space 55 into the recuperator 40, and a second partial air flow L2 is heated in the counter flow. Optionally, the first partial air flow L1 may also have been preheated in the recuperator 40. The second preheated partial air flow L2 is fed to the heating space 55. This takes place in the region of an elongated flame 56, this flame 56 having different flame zones. A first flame zone 56*a* is located within the mixing and combustion chamber 54, wherein the air feed pipe 30 forms a combustion chamber opening 53 through which the flame 56 extends from the igniting and mixing device 51. A second flame zone 56*b* is formed in the heating space 55 in front of the combustion chamber opening 53. The second preheated partial air flow L2 is fed to the flame zone 56*b* from the recuperator 40. At the same time, hot waste gases A2 are suctioned from the heating space 55 into the flame zone 56*b*.

In this burner configuration, the cross-section of the combustion chamber opening 53 relative to the burner output is in the range of between 1.5 $mm^2/kW$ and 5 $mm^2/kW$, particularly preferably between 2.5 $mm^2/kW$ and 3.5 $mm^2/kW$, for instance. This leads to high exit speeds at the combustion chamber opening 53, which cause low NOx values in the flame zone 56*b*. Together with the NOx formation of the flame 56 within the mixing and combustion chamber, low NOx values, on the whole, in the range of 5 to 100 $mg/Nm^3$ relative to 3% $O_2$ in dry waste gas can be obtained with direct firing. Moreover, the flame 56 is easily monitored, wherein an ionization bar 52, with which the presence of the flame 56 can be detected, is provided in the mixing and combustion chamber 54 for this purpose.

Figure 2:
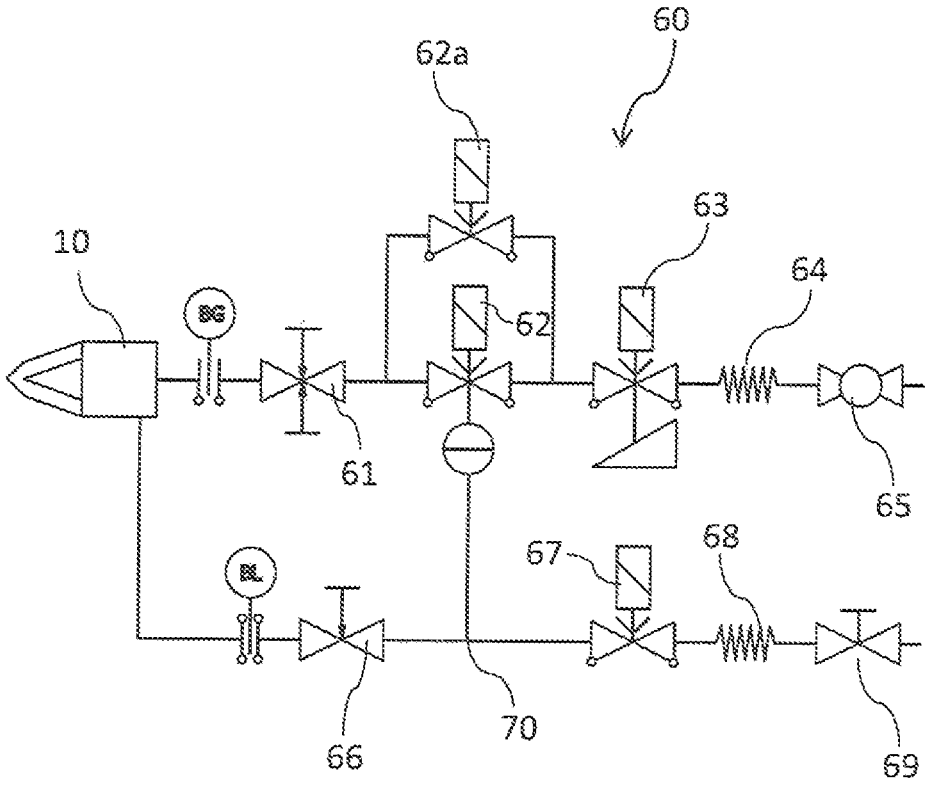
FIG. 2 shows an illustration of an embodiment of control means for controlling a burner in a flow chart.

In order to bring the burner into the operating state of FIG. 1, a heating-up phase with a certain control of the fuel flow B and the partial air flows L1, L2 preferably takes place in order to be able to generate a stable flame 56 even in the case of a cold burner 10. Control means 60, whose configuration can be gathered by way of example from FIG. 2, are provided for this purpose. A burner 10 is equipped with control means 60 that enable the burner 10 to be supplied with fuel and air. Hereinafter, the fuel is simply referred to as gas. Starting from the burner 10, a series of an adjusting valve 61, a gas valve 63, a compensator 64 and a spherical valve 65 for connection to a gas supply (not shown) is provided for the gas flow. Starting from the burner 10, a series of an adjusting valve 66, an air valve 67, a compensator 68 and a gate valve 69 for connection to an air supply (not shown) is provided for the air flow. A balanced pressure regulator 62 with a gas valve and a further gas valve 62*a* in a bypass are provided in a parallel connection between the adjusting valve 61 and the gas valve 63. Between the adjusting valve 66 and the air valve 67, an impulse line 70 branches off towards the balanced pressure regulator 62 with the gas valve.

With these control means the burner can be started up, at first in a cold state, with a fuel-to-air ratio of about 1:20, which enables the formation of a stable flame 56. In the process, the full amount of air is already made available, whereas the fuel flow is at first reduced by means of the valve 62*a*. Depending on the configuration of the burner 10 and the ambient conditions in a furnace, the fuel flow may be increased from a predetermined temperature, because the flame 56 now stabilizes even at a higher fuel percentage. From this temperature on, a switch is made for the fuel flow from the valve 62*a* to the valve 62, the fuel flow is thus increased, and a fuel-to-air ratio of approximately 1:10 is set in the process, for example.

Figure 3:
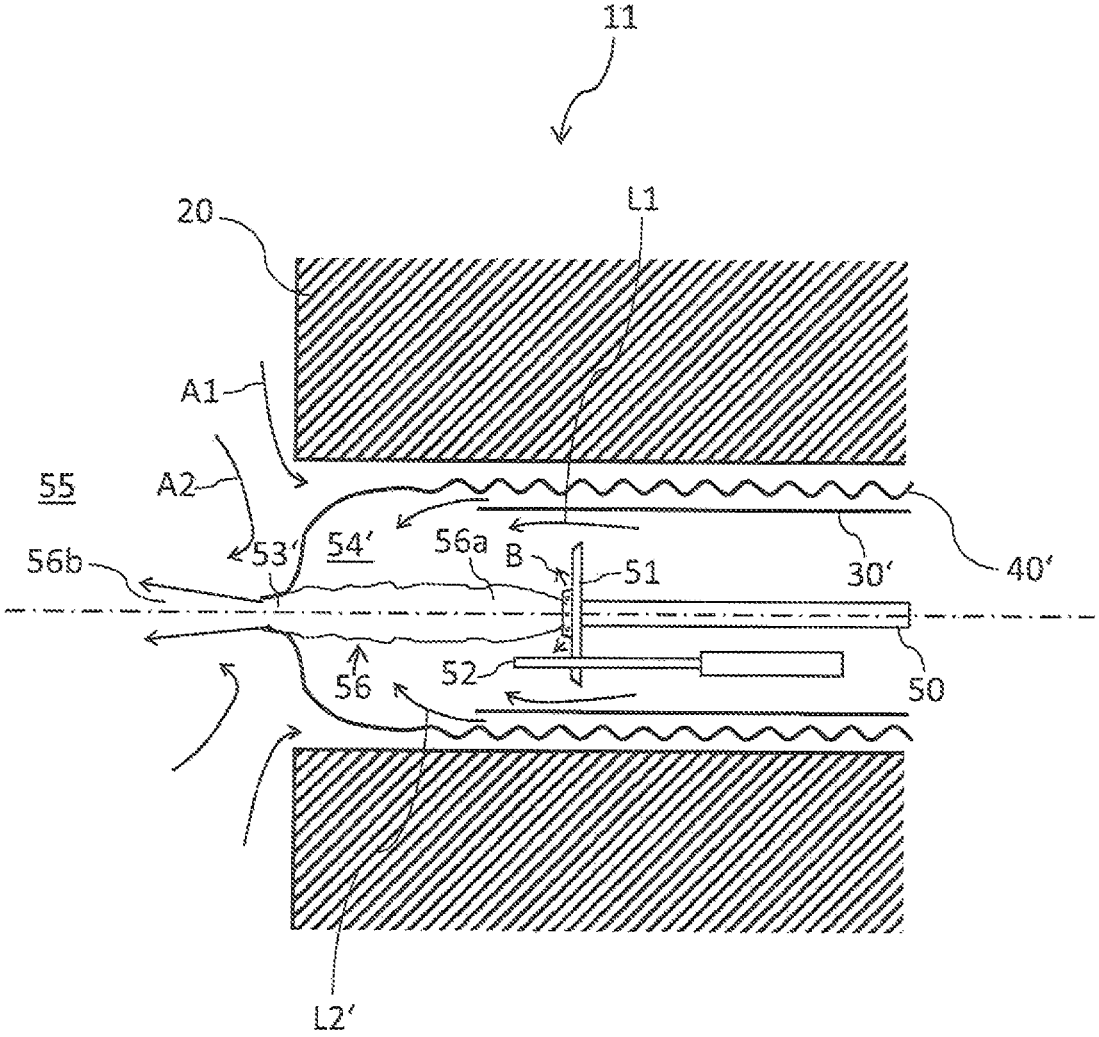
FIG. 3 shows a schematic cross-section through a second embodiment of a burner according to an embodiment.

FIG. 3 shows an alternative embodiment of the burner 11 according to the invention, in which, however, the recuperator 40 forms the combustion chamber opening 53'. Thus, the second partial air flow L2' preheated in the recuperator 40' leads into the mixing and combustion chamber 54' together with the first partial air flow L1. However, the flame 56 with the two flame zones 56*a* and 56*b* is formed in an analogous manner, and the other components also correspond to the embodiment of FIG. 1. Only the cross-section of the combustion chamber opening 53' relative to the burner output is in this case in the range of between 3 $mm^2/kW$ and 10 $mm^2/kW$, particularly preferably between 3 $mm^2/kW$ and 6 $mm^2/kW$.

FIG. 4 shows a burner 12 according to the embodiment of FIG. 3, in which a heating space 55' to be heated is disposed within a flame tube 42. The flame tube 42 is surrounded by a radiant tube 41 which protrudes from the furnace wall 20 into a furnace interior space for indirect heating. The flame tube 42 within the radiant tube 41 permits the flow of hot waste gases A3 back to the burner 12, wherein they are either fed as waste gases A1 to the recuperator, or suctioned in as waste gases A2 by the flame zone 56*b*. If an SER radiant tube is used, for example, NOx values in the range of 50 to 150 $mg/Nm^3$ relative to 3% $O_2$ in dry waste gas can be obtained with the invention.

LIST OF REFERENCE NUMERALS

10, 11, 12 Burner
20 Furnace wall
30, 30' Air feed, air feed pipe
40, 40' Recuperator
41 Radiant tube
42 Flame tube
50 Fuel feed
51 Mixing and igniting device
52 Flame monitoring means, ionization bar
53 Burner chamber opening
54, 54' Mixing and combustion chamber
55, 55' Heating space
56 Flame
56*a*, 56*b* Flame zone
60 Control means
61 Adjusting valve gas
62 Balanced pressure regulator with gas valve V2
62*a* Gas valve bypass
63 Gas valve V1
64 Compensator
65 Spherical valve
66 Adjusting valve air
67 Air valve
68 Compensator
69 Gate valve
70 Impulse line
L1 Partial air flow
L2 Partial air flow, preheated
B Fuel flow
A1 Waste gas flow in recuperator
A2 Waste gas flow in flame
A3 Waste gas flow return feed

What is claimed is:

1. A method for operating a burner for heating a heating space with a reduction of NOx emissions, the burner comprising:

a mixing and combustion chamber;

a mixer-igniter disposed in the mixing and combustion chamber;

a fuel feed connected to the mixer-igniter mixing and igniting device and adapted to feed fuel to the mixer-igniter;

an air feed adapted to feed at least one partial air flow to the mixing and combustion chamber;

a combustion chamber opening adapted to open the mixing and combustion chamber towards a heating space to be heated;

a controller adapted to control a fuel flow via the fuel feed and for controlling at least one partial air flow via the air feed, wherein the burner and the controller operate the burner with a stable flame extending from the mixer-igniter through the combustion chamber opening into the heating space; and a cross-section of the combustion chamber opening relative to the burner output is in a range of between 1.5 $mm^2/kW$ and 10 $mm^2/kW$, the method comprising:

subsequent to a parameter value reaching a prescribed value, increasing, by the controller, the fuel flow via the fuel feed while maintaining the air flow via the air feed substantially the same as prior to increasing the fuel flow so that a ratio of the fuel flow to the airflow is changed from 1:20 to 1:10 without extinguishing the stable flame.

2. The method according to claim 1, wherein the cross-section of the combustion chamber opening relative to the burner output is further limited to in the range of between 1.5 $mm^2/kW$ and 8 $mm^2/kW$.

3. The method according to claim 1, wherein the air feed is formed by an air feed pipe, within which the mixer-igniter is disposed in such a way that the mixing and combustion chamber is formed, and that the air feed pipe forms the combustion chamber opening.

4. The burner method according to claim 1, wherein the cross-section of the combustion chamber opening relative to the burner output is further limited to in the range of between 1.5 $mm^2/kW$ and 5 $mm^2/kW$.

5. The method according to any one of the claim 1, wherein it includes a recuperator, which at least partially surrounds the air feed and via which a second partial air flow can be fed to the mixing and combustion chamber or the heating space outside the mixing and combustion chamber.

6. The method according to claim 5, wherein the air feed is formed by an air feed pipe, within which the mixer-igniter is disposed in such a way that the mixing and combustion chamber is formed, and that the recuperator forms the combustion chamber opening, while the second partial air flow is guided from the recuperator into the mixing and combustion chamber.

7. The method according to claim 6, wherein the cross-section of the combustion chamber opening relative to the burner output is further defined to be in between 3 $mm^2/kW$ and 10 $mm^2/kW$.

8. The method according to claim 1, wherein the parameter is a temperature in a space to be heated.

9. The method according to claim 8, wherein the temperature is between 200° C. and 500° C.

10. The method according to claim 1, wherein the burner further comprises a flame detector, wherein flame detector is configured for detecting a flame in the region of the mixer-igniter, in the mixing and combustion chamber, and wherein the method further comprises:

detecting a flame by the flame detector.

11. The method according to claim 1, wherein the cross-section of the combustion chamber opening relative to the burner output is further limited to in the range of between 1.5 $mm^2/kW$ and $mm^2/kW$.

12. The method according to claim 1, wherein the cross-section of the combustion chamber opening relative to the burner output is further limited to in the range of between 2.5 $mm^2/kW$ and 3.5 $mm^2/kW$.

13. The method according to claim 6, wherein the cross-section of the combustion chamber opening relative to the burner output is further defined to be in a range of between 3 $mm^2/kW$ and 6 $mm^2/kW$.

14. The method according to claim 8, wherein the temperature is between 200° C. and just below the temperature for flameless oxidation.

* * * * *